US007836838B2

(12) United States Patent
Makino et al.

(10) Patent No.: US 7,836,838 B2
(45) Date of Patent: Nov. 23, 2010

(54) SEWING MACHINE AND COMPUTER-READABLE RECORDING MEDIUM WITH RECORDED SEWING MACHINE CONTROL PROGRAM

(75) Inventors: Satoru Makino, Nagoya (JP); Hirokazu Hirose, Chiryu (JP); Yoshio Nishimura, Nagoya (JP); Masaki Shimizu, Toyoake (JP); Akie Ukai, Nagoya (JP); Yoshinori Nakamura, Toyohashi (JP); Kazumi Sai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 423 days.

(21) Appl. No.: 12/071,368

(22) Filed: Feb. 20, 2008

(65) Prior Publication Data

US 2008/0196646 A1 Aug. 21, 2008

(30) Foreign Application Priority Data

Feb. 21, 2007 (JP) ..... 2007-040326

(51) Int. Cl.
*D05B 19/00* (2006.01)
*D05B 69/10* (2006.01)

(52) U.S. Cl. ..... 112/470.01; 112/220; 700/136

(58) Field of Classification Search ..... 112/470.01, 112/470.04, 220, 221, 235–239; 700/136, 700/138

See application file for complete search history.

(56) References Cited

U.S. PATENT DOCUMENTS

| | | | | |
|---|---|---|---|---|
| 4,077,340 | A * | 3/1978 | Braun et al. | 112/131 |
| 4,129,084 | A * | 12/1978 | Kihara | 112/221 |
| 4,193,362 | A * | 3/1980 | Glaser | 112/275 |
| 4,524,703 | A * | 6/1985 | Willenbacher | 112/98 |
| 5,081,945 | A * | 1/1992 | Bozoglou | 112/470.31 |
| 5,836,260 | A * | 11/1998 | Kawaguchi et al. | 112/277 |
| 6,352,043 | B1 * | 3/2002 | Tajima et al. | 112/102.5 |
| 6,732,668 | B2 * | 5/2004 | Zesch et al. | 112/102.5 |
| 6,843,190 | B1 * | 1/2005 | LaPierre-McAfee | 112/475.01 |

FOREIGN PATENT DOCUMENTS

| | | | |
|---|---|---|---|
| JP | A-46-1137 | | 1/1971 |
| JP | A-54-163154 | | 12/1979 |
| JP | A-57-173088 | | 10/1982 |
| JP | A-58-112583 | | 7/1983 |
| JP | 403247388 | A * | 11/1991 |
| JP | A-5-5262 | | 1/1993 |

* cited by examiner

*Primary Examiner*—Ismael Izaguirre
(74) *Attorney, Agent, or Firm*—Oliff & Berridge, PLC

(57) ABSTRACT

A sewing machine includes a needle bar that is equipped with a sewing needle at a lower end of the needle bar, a presser bar that is equipped with a presser foot at a lower end of the presser bar, which holds down a work cloth, a sewing machine motor which is a driving source that drives the needle bar in an up and down direction, and a switching device that switches between a normal mode in which the needle bar is driven in the up and down direction to form stitches and a practice mode in which the sewing machine is operated in a condition where at least the needle bar is not driven.

9 Claims, 13 Drawing Sheets

SEWING MACHINE AND COMPUTER-READABLE RECORDING MEDIUM WITH RECORDED SEWING MACHINE CONTROL PROGRAM

CROSS-REFERENCE TO RELATED APPLICATION

This Application claims priority to Japanese Patent Application No. 2007-040326, filed Feb. 21, 2007, the content of which is hereby incorporated herein by reference in its entirety.

BACKGROUND

The present disclosure relates to a sewing machine and a computer-readable recording medium with a program that controls the sewing machine. More specifically, it relates to a sewing machine capable of practicing sewing and a computer-readable recording medium with a program that controls the sewing machine.

Conventionally, in quilting-sewing by which a batting is put between an outer material and a lining material so that these materials then may be sewed along a stitch pattern such as a straight line or a curve, free motion sewing has been carried out to form stitches by arbitrarily moving the work cloth manually by a user.

In this type of free motion sewing, to prevent stitches from looking unattractive due to non-uniformity in the pitch of the stitches, it is preferable to provide uniform stitch pitches as much as possible in sewing. However, it is difficult for a beginner to sew two pieces of work cloth in such a manner as to provide roughly uniform stitch pitches for the pieces while moving them in a desired direction.

To address this problem, it has been proposed that a work of sewing performed by a highly skilled person be recorded so that the recorded information may be reproduced in later sewing. For example, a teaching-purpose embroidering sewing machine described in Japanese Patent Application Laid Open Publication No. Hei 5-5262 is equipped with a tablet and a cursor which are used to detect the position information of a movement frame (which corresponds to an embroidery frame). In this teaching-purpose embroidering sewing machine, the cursor is fixed to the movement frame over which a piece of cloth is stretched, so that the position information of the movement frame that is moved by the skilled person is detected from the tablet and is stored. Based on this stored data, a drive mechanism for the movement frame is driven, to repeatedly reproduce the work of embroidery sewing by the skilled person.

SUMMARY

However, because the apparatus disclosed in Japanese Patent Application Laid Open Publication No. HEI 5-5262 records the position information of the movement frame, the apparatus cannot be used in free motion sewing, in which the user moves a piece of work cloth in sewing without using a movement frame. The apparatus has another problem that, to practice free motion sewing, an extra piece of work cloth and a thread is necessary for test-sewing.

The present disclosure addresses these problems. It is an object of the present disclosure to provide a sewing machine that can repeatedly practice free motion sewing without requiring a piece of work cloth or a thread for test-sewing, and a computer-readable recording medium with a program that controls the sewing machine.

To address the above problems, a first aspect of the present disclosure provides a sewing machine comprising a needle bar that is equipped with a sewing needle at a lower end of the needle bar, a presser bar that is equipped with a presser foot at a lower end of the presser bar which holds down a work cloth, a sewing machine motor which is a driving source that drives the needle bar in an up and down direction, and a switching device that switches between a normal mode in which the needle bar is driven in the up and down direction to form stitches and a practice mode in which the sewing machine is operated in a condition where at least the needle bar is not driven.

A second aspect of the present disclosure provides a computer-readable recording medium storing a sewing machine control program, the recording medium comprising switching instructions for switching between a normal mode in which a needle bar having a sewing needle attached to a lower end of the needle bar, is driven in an up and down direction to form stitches and a practice mode in which a sewing machine is operated in a condition where at least the needle bar is not driven.

BRIEF DESCRIPTION OF THE DRAWINGS

Exemplary embodiments of the invention will be described below in detail with reference to the accompanying drawings in which.

DETAILED DESCRIPTION

The following describes first through third embodiments of the present disclosure with reference to the drawings. First, the first embodiment is described below with reference to FIGS. 1-7. It is to be noted that in FIGS. 1 and 2, the side of the paper that faces toward the user is referred to as the front side, the side that faces away from the user is referred to as the rear side, and the right and left direction of the paper is referred to as the right and left direction.

Figure 1:
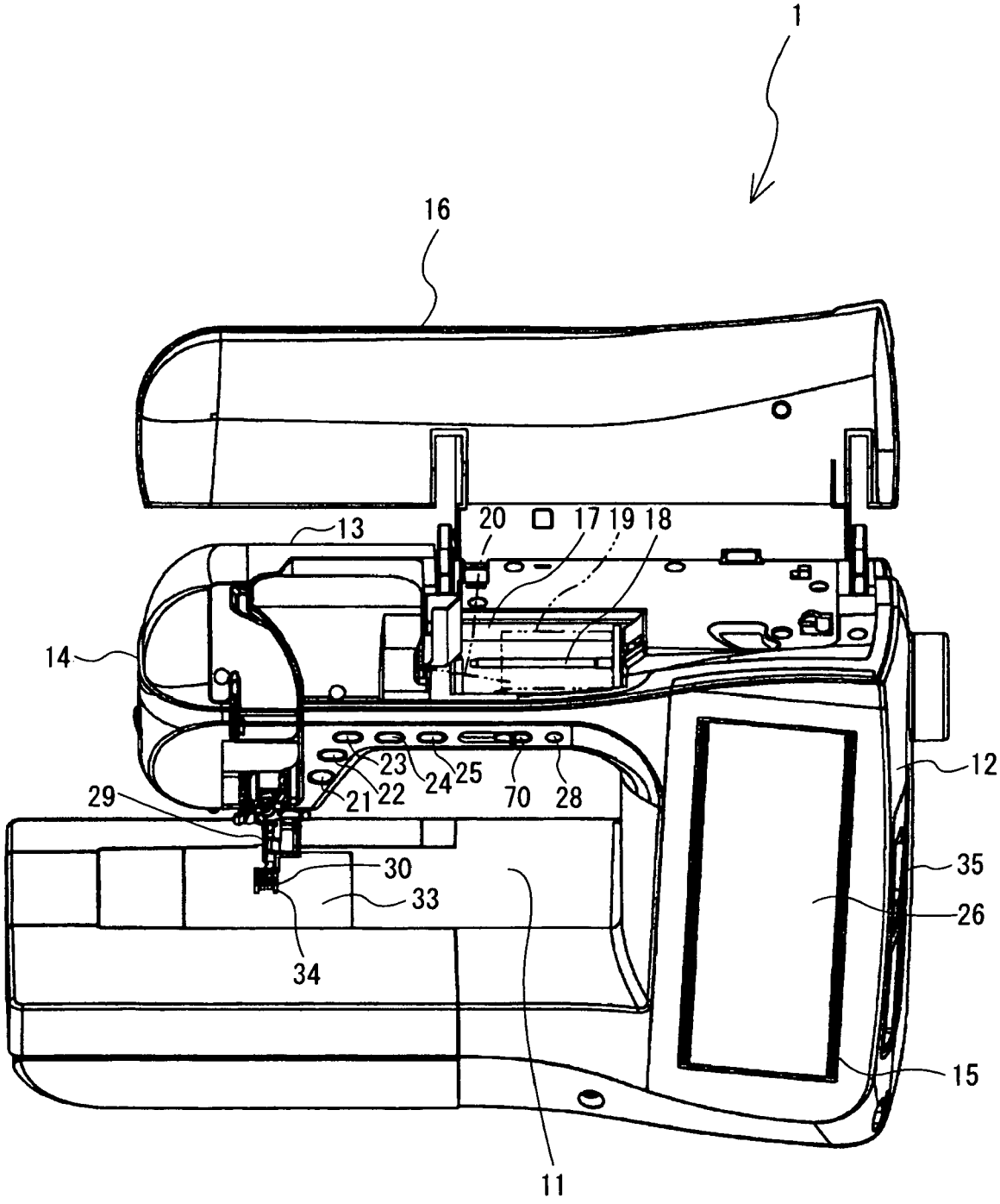
FIG. 1 is a perspective view as viewed from the upper side of a sewing machine in a condition where an open-and-close cover is open.

As shown in FIG. 1, a sewing machine 1 has a sewing machine bed 11 which extends in the right and left direction, a pillar 12, an arm portion 13, and a head portion 14. The pillar 12 is erected upward at the right end of the sewing machine bed 11. The arm portion 13 extends leftward in FIG. 1 at the upper end of the pillar 12. The head portion 14 is provided at the left end of the arm portion 13. The sewing machine bed 11 is equipped with a needle plate 33, a feed dog 34, a cloth feed mechanism (not shown), a feed adjustment pulse motor 78 (see FIG. 3), and a shuttle mechanism (not shown). The needle plate 33 is disposed on the top surface of the sewing machine bed 11. The feed dog 34 is mounted under the needle plate 33 to feed a work cloth (not shown) for sewing by a predetermined feed amount. The cloth feed mechanism may drive the feed dog 34. The feed adjustment pulse motor 78 may adjust a feed amount. The head portion 14 is equipped with a needle bar mechanism (not shown), a needle bar swinging pulse motor 80 (see FIG. 3), and a thread take-up mechanism (not shown). The needle bar mechanism is used to drive a needle bar to which a sewing needle 29 is attached, in the up and down direction. The needle bar swinging pulse motor 80 may swing the needle bar in the right and left direction. The pillar 12 may be equipped with a liquid crystal display (LCD) 15 on its front surface. The LCD 15 displays a screen used for making various settings.

The pillar 12 may be equipped with a card slot 35 on its right side surface in FIG. 1. When a memory card (not shown) is inserted into the card slot 35, it is possible to input various kinds of sewing data and programs stored in the memory card into the sewing machine, as well as to output data stored in the sewing machine 1 to the memory card for use outside of the sewing machine 1. In the right rear side of the pillar 12, a power supply switch 27 (see FIG. 3) is provided which turns ON/OFF the power supply of the sewing machine 1.

Next, the configuration of the arm portion 13 is described. The arm portion 13 is mounted with an open-and-close cover 16 which is used to open and close an upper part of the arm portion 13. The open-and-close cover 16 is mounted along the longitudinal direction of the arm portion 13 and pivots about the upper rear part of the arm portion 13 so that it may be opened and closed around the right-and-left directional axis of the arm portion 13. When the open-and-close cover 16 is opened, the user can access a thread spool housing 17 formed in the vicinity of the midsection of the upper surface of the arm portion 13. The thread spool housing 17 is concaved to contain a thread spool 19 for supplying a thread to the sewing machine 1. On the inner wall surface of the thread spool housing 17 and to the side of the pillar 12, a thread spool pin 18 is disposed. The thread spool pin 18 protrudes toward the head portion 14. The thread spool 19 is attached to the thread spool pin 18. The thread spool 19 is attached to the thread spool pin 18 when the thread spool pin 18 is inserted through an insertion hole formed in the thread spool 19. A needle thread 20 extending from the thread spool 19 passes through a tensioner (not shown). A thread take-up spring (not shown) which is mounted on the head portion 14 may adjust a thread tension. Additionally, a plurality of thread hooking sections (not shown), such as a thread take-up lever etc. for taking up the needle thread by reciprocating in the up and down direction is supplied to the sewing needle 29 attached to a needle bar.

The arm portion 13 has a sewing machine drive shaft (not shown). The sewing machine drive shaft extends along the longitudinal direction of the arm portion 13 and is rotary-driven by a sewing machine motor 79 (see FIG. 3). When the sewing machine drive shaft revolves, the needle bar mechanism and the thread take-up mechanism are driven.

A sewing start switch 21, a sewing stop switch 22, a needle up-and-down switch 23, a presser foot elevation switch 24, a reverse stitch switch 25, a speed control lever 70, and a mode transfer switch 28 are mounted at the lower part of the front surface of the head portion 14 and the arm portion 13. The sewing start switch 21 may initiate the start of sewing machine operation, i.e., the start of sewing. The sewing stop switch 22 may cause the sewing machine operation to stop, i.e., send an instruction to stop sewing. The needle up-and-down switch 23 may toggle the stop position of the sewing needle between an upper position and a lower position. The presser foot elevation switch 24 may raise and lower a presser foot 30. The reverse stitch switch 25 may feed a work cloth from the rear side to the front side, which is opposite to a normal direction. The speed control lever 70 may set the sewing speed. The mode transfer switch 28 may toggle between a practice mode and a normal mode, which will be described later.

Besides the above-described needle bar, thread take-up lever, tensioner, and the thread take-up spring, the head portion 14 may be equipped with an automatic thread hooking apparatus, an automatic threading mechanism, etc. (not shown. Behind the needle bar, a presser bar 31 may be disposed (see FIG. 2) which is supported on the frame of the sewing machine in such a manner that it can be raised and lowered. The lower end of the presser bar 31 is equipped with a presser foot 30 which presses the work cloth to the feed dog 34 with appropriate pressure.

Figure 2:
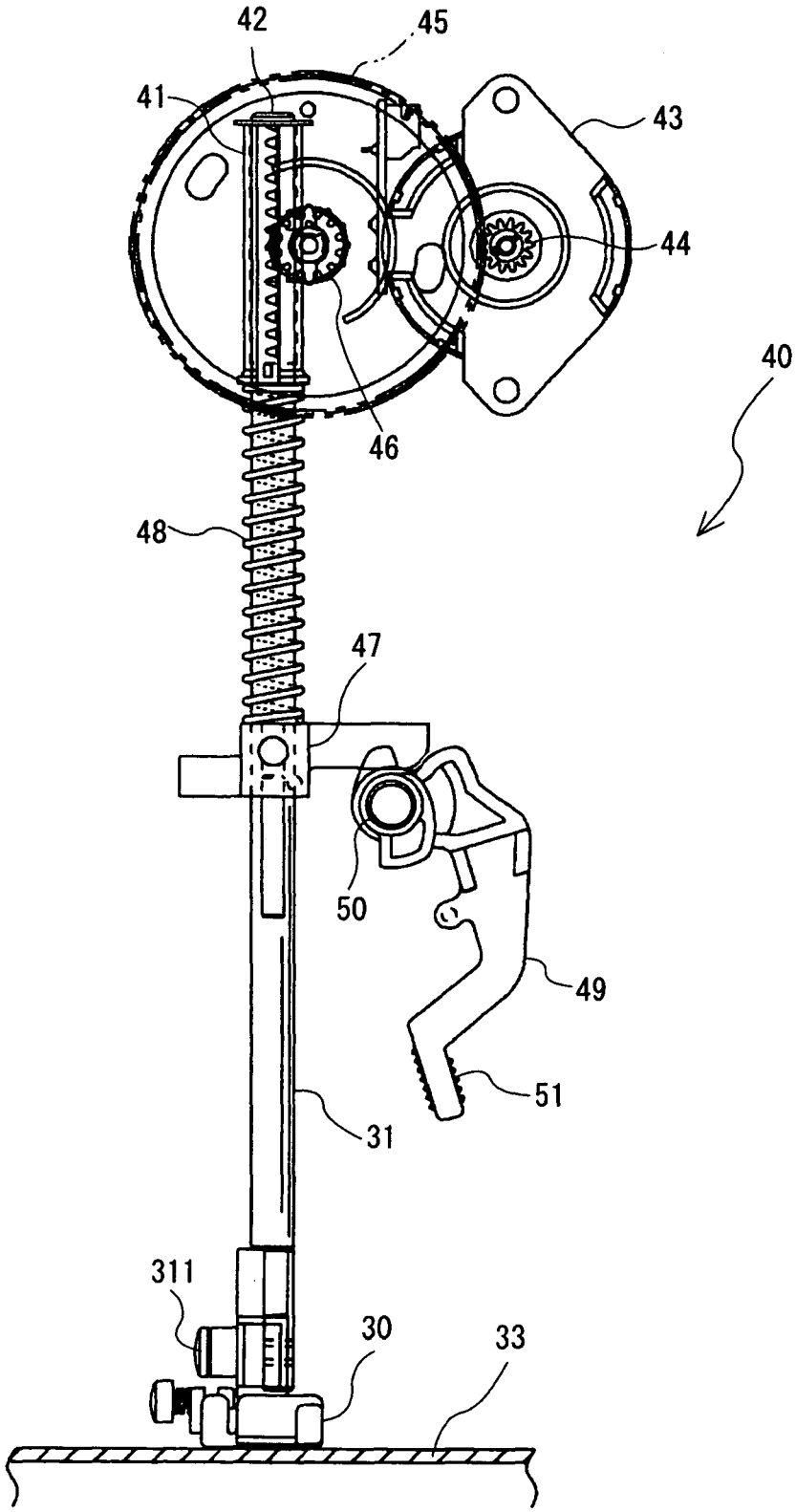
FIG. 2 is a front view of relevant components of an elevation mechanism in the sewing machine that elevates a presser foot.

An elevation mechanism 40 which raises and lowers the presser bar 31 is described below with reference to FIG. 2. The elevation mechanism 40 may be equipped behind the needle bar. The elevation mechanism 40 may be positioned with the presser bar 31, the presser foot 30, a rack formation member 41, and a retaining ring 42. The presser bar 31 may be supported on the frame of the sewing machine in such a manner that it can be raised and lowered. The presser foot 30 may be attached to the lower end of the presser bar 31 with a screw 311. The rack formation member 41 is externally fitted to the upper end of the presser bar 31 in such a manner that it can be raised and lowered. The retaining ring 42 is fixed to the upper end of the presser bar 31. The elevation mechanism 40 may be equipped with a presser foot elevation pulse motor 43, a drive gear 44, a pinion 46 which meshes with an intermediate gear 45, a presser bar guide bracket 47, and a presser spring 48. The presser foot elevation pulse motor 43 is a drive mechanism which raises and lowers the presser bar 31. The drive gear 44 may be coupled to an output shaft of the presser foot elevation pulse motor 43. The intermediate gear 45 may mesh with the drive gear 44. The pinion 46 may be formed integrally with the intermediate gear 45 and may mesh with the rack formation member 41. The presser bar guide bracket 47 is fixed at the height-directional midsection stage of the presser bar 31. The presser spring 48 may be externally mounted to the presser bar 31 between the rack formation member 41 and the presser bar guide bracket 47.

The presser bar 31 is raised and lowered as driven by the presser foot elevation pulse motor 43 as follows. First, when the presser foot elevation pulse motor 43 is driven, its drive power is transmitted to the intermediate gear 45 and the pinion 46, thereby raising and lowering the rack formation member 41. If the rack formation member 41 is raised, the upper end surface of the rack formation member 41 butts against the retaining ring 42 fixed to the upper end of the presser bar 31, thereby raising the presser foot 30. Conversely, if the rack formation member 41 is lowered when the presser foot elevation pulse motor 43 is driven, the presser spring 48 is pressed downward and abuts the lower end of the rack formation member 41. In turn, the presser bar guide bracket 47 fixed to the presser bar 31 also is pressed downward, to press the presser foot 30 downward to such a lower position at which the presser foot 30 butts against the needle plate 33. Further, a potentiometer 52 (see FIG. 3) which detects the elevation positions of the presser foot 30 may be mounted to the presser bar 31 to check if the presser bar 31 is raised or lowered to a predetermined position when it is driven by the presser foot elevation pulse motor 43.

The elevation mechanism 40 may be equipped with a presser bar lifter lever 49. The presser bar lifter lever 49 may raise and lower the presser bar 31 by manual motion, independently of the operations to raise and lower the presser bar 31 by the presser bar elevation pulse motor 43. The presser bar lifter lever 49 has one end supported by a pivot pin 50 such that the presser bar lifter lever 49 is fixed to the sewing machine frame in such a manner that it is allowed to swing. The other end of the presser bar lifter lever 49 is fitted with an operation lever 51 for manual operations. If the operation lever 51 is operated manually to swing the presser bar lifter lever 49, the presser foot 30 is raisable from a lower position at which it butts against the needle plate 33 to an upper position which is higher than the needle plate 33 by a predetermined distance.

Figure 3:
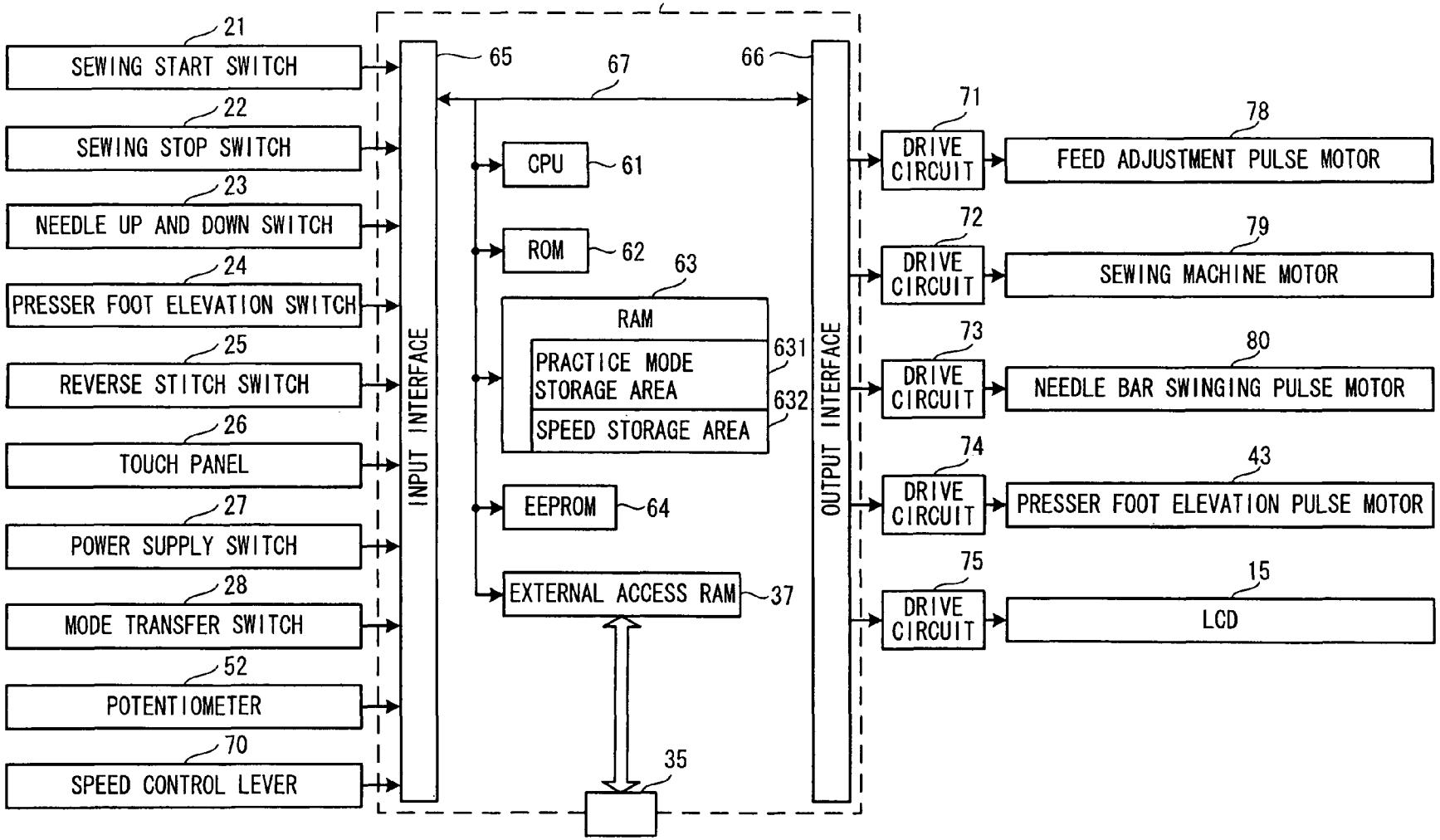
FIG. 3 is a block diagram showing the electrical configuration of the sewing machine according to a first embodiment.

Next, the electrical configuration of the sewing machine 1 is described below with reference to FIG. 3. As shown in FIG. 3, the apparatus body 60 of the sewing machine 1 may include a CPU 61, a ROM 62, a RAM 63, an EEPROM 64, the card slot 35, an external access RAM 37, an input interface 65, and an output interface 66, etc., which are connected to each other with a bus 67. The input interface 65 may be connected to the sewing start switch 21, the sewing stop switch 22, the needle up-and-down switch 23, the presser foot elevation switch 24, the reverse stitch switch 25, a touch panel 26, the potentiometer 52, and the speed control lever 70. The output interface 66 may be connected with drive circuits 71-75 electrically. The drive circuit 71 may drive the feed adjustment pulse motor 78. The drive circuit 72 may drive the sewing machine motor 79, which rotary-drives the sewing machine drive shaft. The drive circuit 73 may drive the needle bar swinging pulse motor 80, which drives the needle bar in a swinging manner. The drive circuit 74 may drive the above-described presser foot elevation pulse motor 43. The drive circuit 75 may drive the LCD 15.

The CPU 61 may serve as a main control over the sewing machine 1 and performs operations and processing in accordance with a control program which may be stored in a control program storage region in the ROM 62. The RAM 63, which is a random access memory, may have as necessary, a sewing pattern data storage region to store data on pattern used for sewing, and a variety of storage regions to store the results of operations performed by the CPU 61. In the present embodiment, the RAM 63 may have a practice mode flag storage area 631 and a speed storage area 632. The practice mode flag storage area 631 may store a value that indicates whether the sewing machine is in the practice mode. Specifically, "1" stored in the practice mode flag storage area 631 indicates that the practice mode flag is "ON", that is, the sewing machine is in the practice mode. On the other hand, "0" stored in the practice mode flag storage area 631 indicates that the practice mode flag is "OFF", that is, the sewing machine is not in the practice mode, but rather is in the normal mode. The practice mode flag is switched each time the mode transfer switch 28 is operated (pressed). The speed storage area 632 may store a speed which is set by the speed control lever 70. The speed control lever 70 can be moved in the right and left direction to thereby control a sewing speed.

The following describes further operations of the sewing machine 1 described above. When the power is supplied to the sewing machine 1, the control program stored in the ROM 62 is performed by the CPU 61, and thereby starts the main processing.

Figure 4:
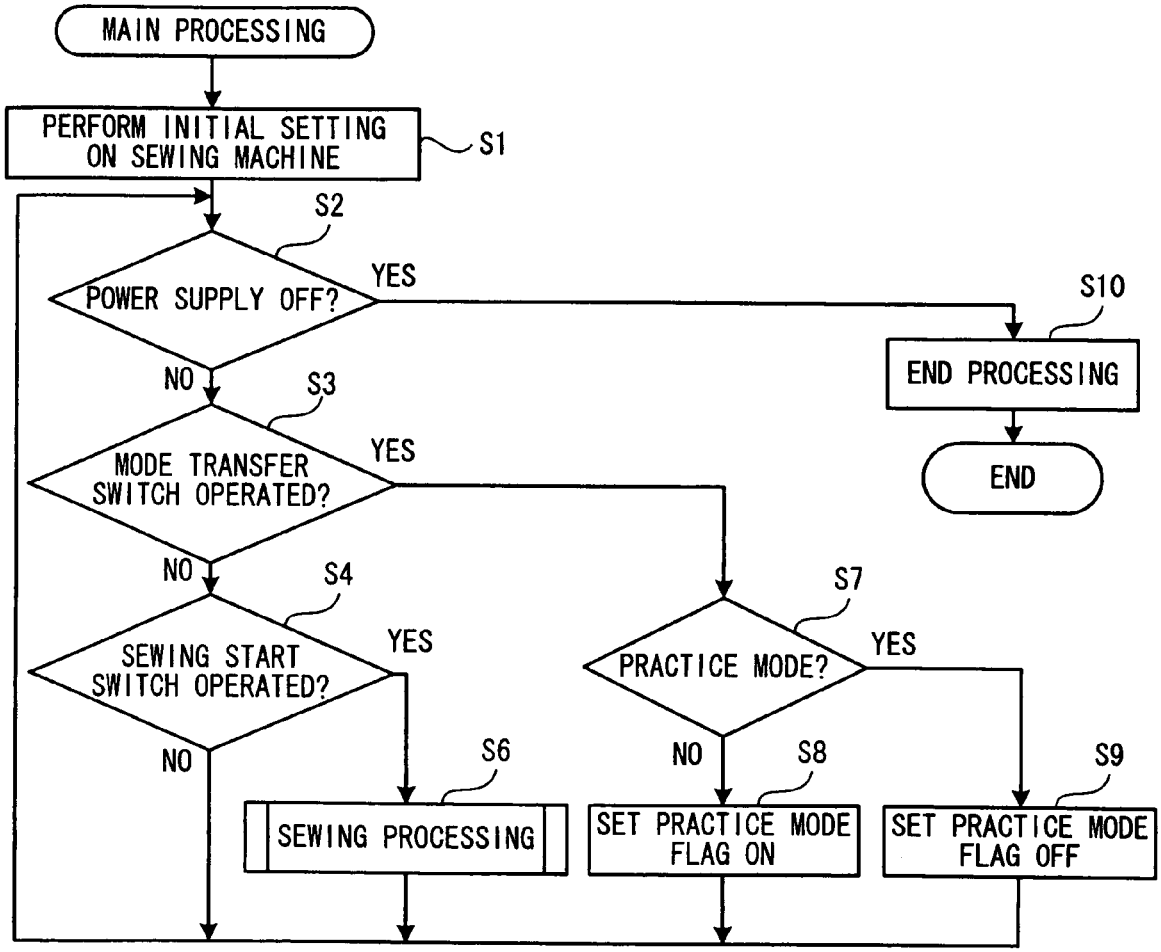
FIG. 4 is a flowchart of main processing for the sewing machine in the first embodiment.

As shown in FIG. 4, the process first performs an initial setting on the sewing machine (S1). In this initial setting, the mode flag is set OFF. That is, the normal mode is entered. Further, a set value of the speed control lever 70 is read and a sewing speed is stored in the RAM 63. Subsequently, in step 2 (S2) it is determined whether the instructions are to turn OFF the power supply. If the power supply switch 27 is operated so that the power supply is instructed to be turned OFF (YES at S2), the process performs end processing at step 10 (S10) to turn off the power supply, and ends the present processing. The power supply for the sewing machine 1 is then turned off.

If is the power supply switch 27 is not instructed to turn OFF the power supply (NO at S2), in step 3 (S3) it is determined whether the mode transfer switch 28 is operated (S3). If the mode transfer switch 28 is operated (YES at S3), in step 7 (S7) it is determined whether the sewing machine is currently in the "practice mode" based on whether the practice mode flag is ON (S7). If the practice mode flag is ON to indicate that the sewing machine is in the "practice mode" (YES at S7), "0" is stored as the practice mode flag and the practice mode flag in step 9 (S9) is set as OFF to enter the "normal mode." On the other hand, if the practice mode flag is OFF to indicate that the sewing machine is in the "normal mode" (NO at S7), in (S8) "1" is stored as the practice mode flag, and the practice mode flag is set as ON to enter the "practice mode." In such a manner, the mode transfer switch 28 is operated to switch between the practice mode and the normal mode. Then, the process may return to S2.

Further, if the mode transfer switch 28 is not operated (NO at S3), in step 4 (S4) it is determined whether the sewing start switch 21 is operated. If the sewing start switch 21 is operated (YES at S4), in step 6 (S6) the sewing processing is performed to start the operation of the sewing machine 1 (see FIG. 5). If the sewing start switch 21 is not operated (NO at S4), the process may return to S2. As shown in the sewing processing of FIG. 5, in step 21 (S21) the preparation for sewing is performed. In the preparation for sewing, the feed adjustment pulse motor 78, the needle bar swinging pulse motor 80, the presser foot elevation pulse motor 43, etc. are initialized. Then, in step 22 (S22) it is determined whether the sewing stop switch 22 is operated. If the sewing stop switch 22 is not operated (NO at S22), in step 23 (S23) it is determined whether the sewing machine is in the "practice mode" based on whether the practice mode flag is ON. If the practice mode flag is ON (YES at S23), in step 24 (S24) the practice sewing control processing is performed that corresponds to the practice mode.

Figure 6:
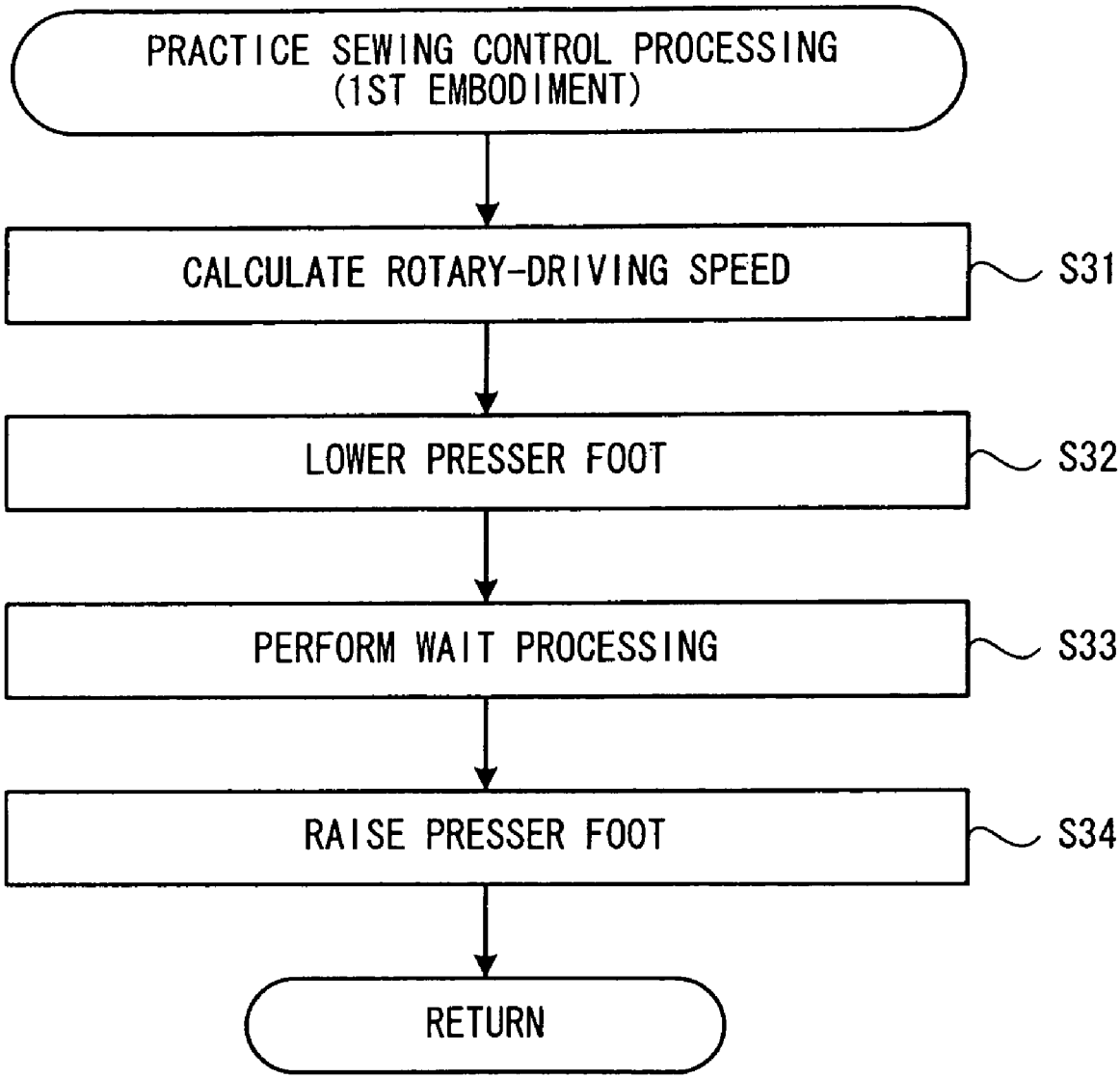
FIG. 6 is a flowchart of practice sewing control processing which is performed in the sewing processing.

In the first embodiment, instead of moving the sewing needle 29 up and down during actual sewing, the presser foot 30 is driven up and down. As shown in FIG. 6, in the practice sewing control in step 31 (S31), a rotary driving speed for the presser foot elevation pulse motor 43 is calculated based on a value set by the speed control lever 70. For example, if the sewing speed is set to 300 stitches per minute (which corresponds to 300 rpm for the drive shaft) for actual sewing, each stitch of the sewing needle 29 (each vertical reciprocation of the needle bar) takes a time lapse of 0.2 seconds for its operation. Therefore, as the presser foot elevation pulse motor 43 is driven, in step 32 (S32) the presser foot 30 is lowered at such a movement speed that it may take 0.2 seconds for the presser bar 31 to reciprocate vertically once (S32). In actual sewing, the sewing needle 29 stays in the work cloth for about 40% of the lapse of time necessary for the needle bar to vertically reciprocate once. Therefore, the actual operations of the needle bar may be approximated more closely if the presser foot 30 stays stationary at its lowered position for a time that corresponds to the lapse of time during which the sewing needle 29 stays in the work cloth. Accordingly, in step 33 (S33) the wait processing is performed for 0.08 seconds, which is 40% of 0.2 seconds, that is, the lapse of time when the presser foot 30 stays at the lowered position. Next, in step 34 (S34) the presser foot elevation pulse motor 43 is driven to raise the presser foot 30 at the same speed as the movement speed for lowering the presser foot 30. Then, the present processing ends and the process returns to the sewing processing. During this lapse of time, the sewing machine motor 79 is not driven to operate the sewing needle 29, and thus sewing is not performed.

Figure 5:
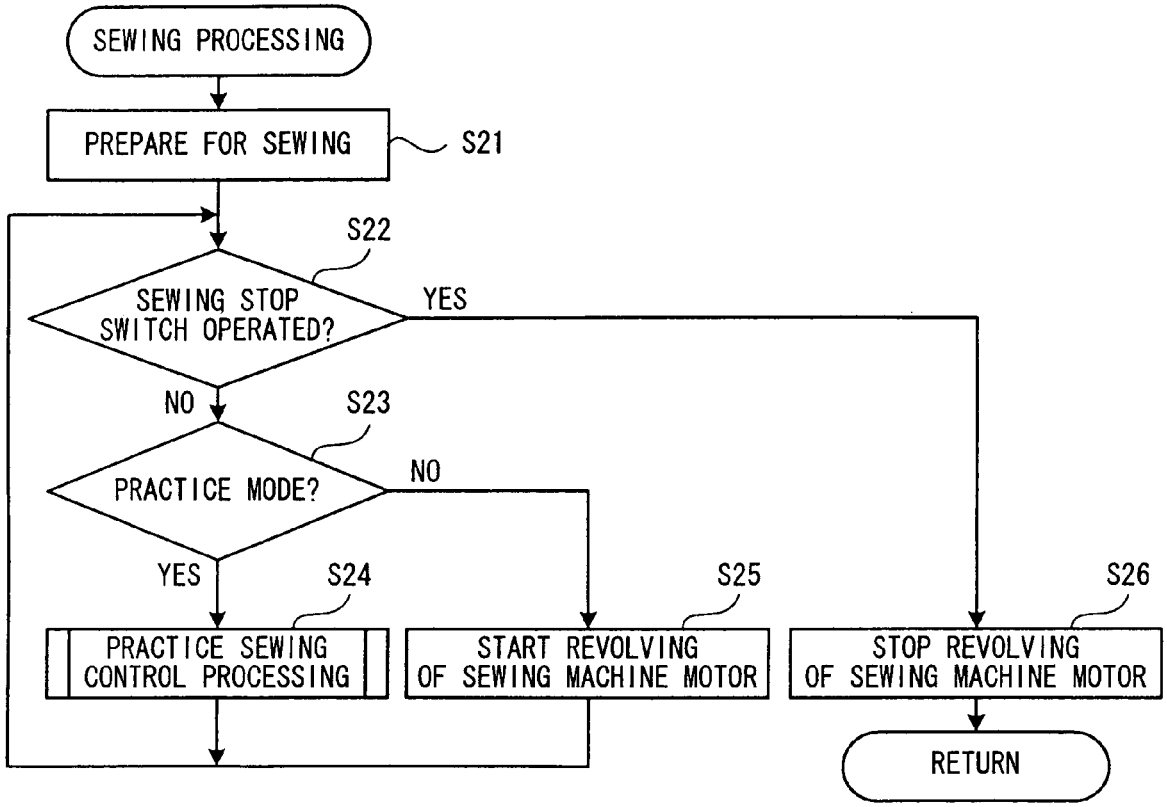
FIG. 5 is a flowchart of sewing processing which is performed in the main processing.

On the other hand, in the sewing processing of FIG. 5, if the sewing machine is in the "normal mode" because the practice mode flag is OFF (NO at S23), normal sewing operations are performed in step 25 (S25) so that the sewing machine motor 79 revolves. As the sewing machine motor 79 revolves, the drive shaft rotates to operate the sewing needle 29 so that sewing may be performed. The process may then return to S22. The processing of S22-S25 or S22-S24 are then repeated, and when the sewing stop switch 22 is operated (YES at S22), sewing is stopped in step 26 (S26) so that the revolving of the sewing machine motor 79 is stopped to end the sewing processing, and the process returns to the main processing.

In such a manner, in the sewing machine 1 in the present embodiment, the user can appropriately switch between the "normal mode" and the "practice mode" in order to match the desired type of sewing. In the "normal mode", normal sewing is performed to drive the needle bar in the up and down direction so that stitches may be formed. In the "practice mode", the sewing machine can be operated in a condition where at least the needle bar is not driven. Specifically, instead of driving the sewing needle 29 independently of the sewing machine motor, the CPU 61 controls the elevation mechanism 40 that drives the presser foot 30 or the presser bar 31 in the up and down direction. Accordingly, in the "practice mode", because the needle bar is not driven, the sewing needle 29 is not used so that just the presser foot 30 is driven in the up and down direction. Therefore, the work cloth is not damaged because the sewing needle does not make a hole in the work cloth. Furthermore, sewing practice can be repeated because no thread is required for this mode. Moreover, the presser foot 30 is driven in the up and down direction instead of the needle bar, so that the user can practice sewing with much the same feeling as if the needle bar is actually being driven in the normal sewing mode.

Figure 7:
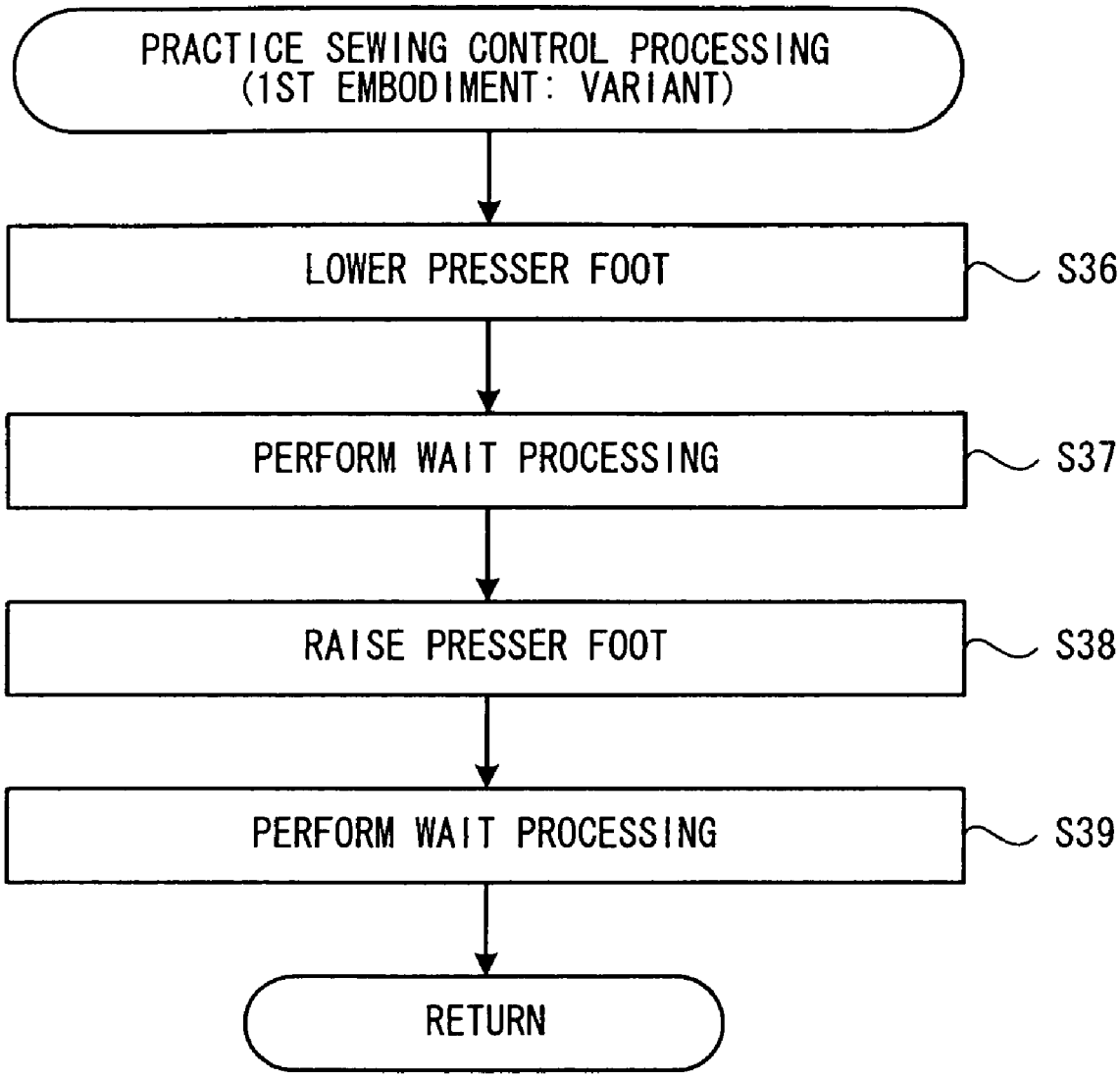
FIG. 7 is a flowchart of the variant of the practice sewing control processing which is performed in the sewing processing.

Further, in the practice sewing control processing, without changing the rotary-driving speed of the presser foot elevation pulse motor 43, the duration of the wait processing may be changed corresponding to a sewing speed which is set with the speed control lever 70. For example, if the sewing speed in actual sewing is set to 300 stitches per minute, it takes 0.2 seconds for each stitch to be formed by the sewing needle 29 (each vertical reciprocation of the needle bar). Further, if it takes, for example, 0.05 seconds each for the elevation mechanism 40 to raise and lower the presser foot 30, the wait lapse of time is 0.05 seconds (=0.1-0.05). The practice sewing control processing in this case is shown in FIG. 7. First, in step 36 (S36) the presser foot 30 is lowered (S36). After performing the wait processing for a predetermined time lapse of 0.05 seconds in step 37 (S37), the presser foot 30 is raised in step 38 (S38). Then, the wait processing for another predetermined time lapse of 0.05 seconds is performed in step 39 (S39), and then the process ends the present processing to return to the sewing processing.

In such a manner, the CPU 61, which adjusts the wait processing lapse of time, can control the speed at which the presser foot is driven in the up and down direction, so that the user can practice sewing by adjusting a driving speed to a level suitable for his/her skills. Further, by appropriately controlling the driving speed when moving or rotating the work cloth in a desired direction, the user can practice sewing with much the same feeling as if he/she is controlling the vertical driving speed of the needle bar in actual sewing, i.e., the rotary speed of the sewing machine drive shaft, which is rotary-driven by the sewing machine motor.

Figure 8:
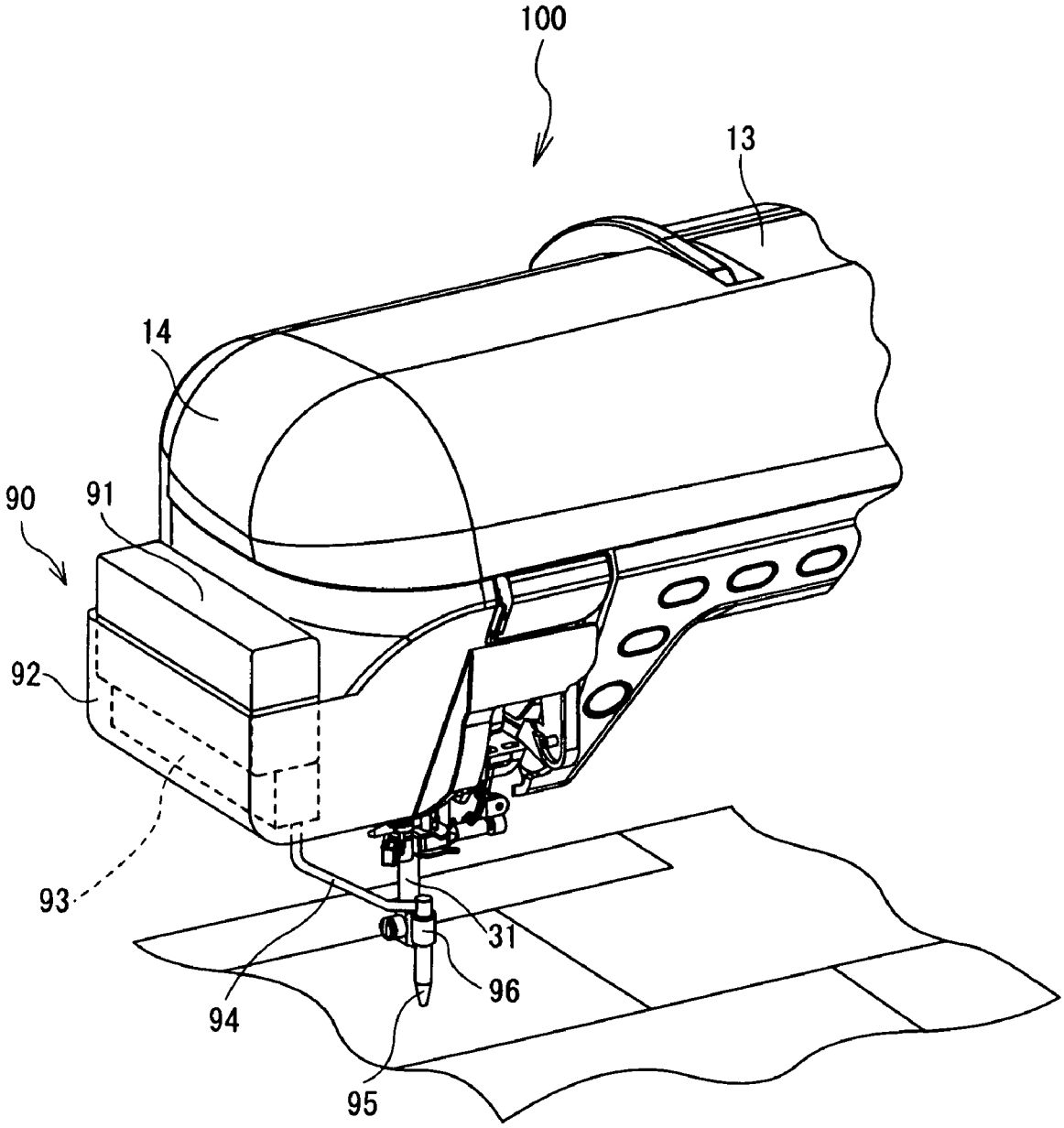
FIG. 8 is an enlarged partial view of the sewing machine showing an ink recorder.
Figure 9:
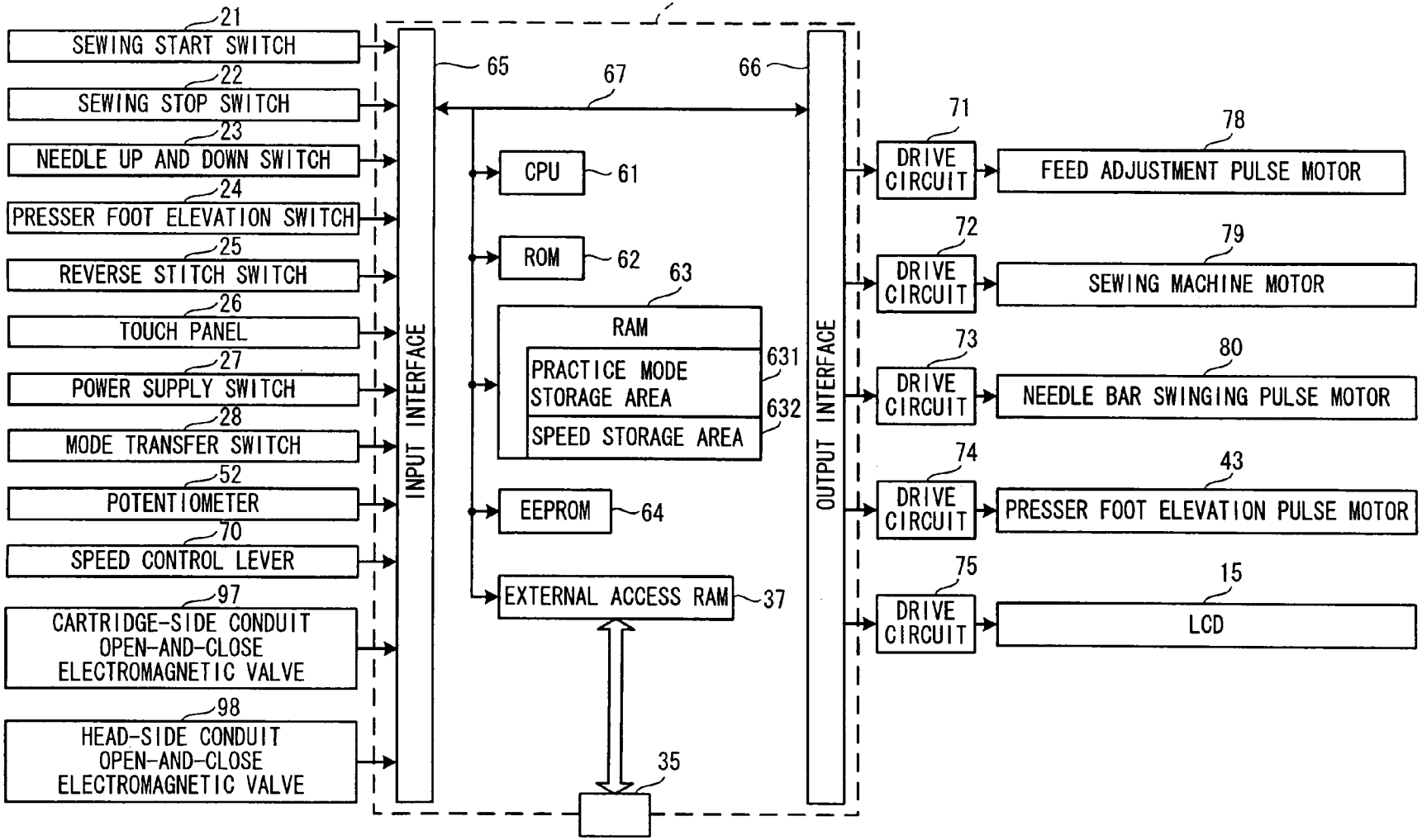
FIG. 9 is a block diagram showing the electrical configuration of the sewing machine according to a second embodiment.
Figure 10:
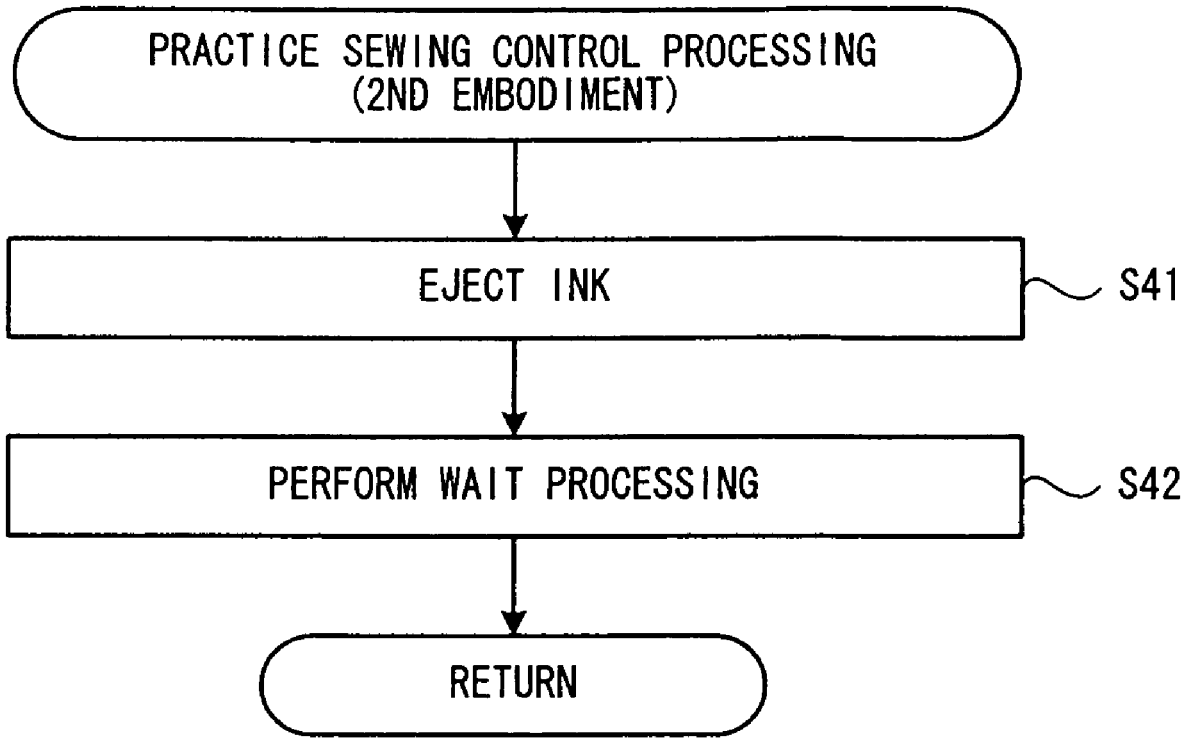
FIG. 10 is a flowchart of the practice sewing control processing in the second embodiment.

Next, the second embodiment is described with reference to FIGS. 8-10. A sewing machine 100 in the second embodiment may be equipped with an ink recorder 90 which has an ink ejection head 95 for ejecting ink. In a practice mode, instead of driving a sewing needle 29, ink is ejected from the ink ejection head 95. Since the sewing machine 100 has the same physical configuration as that in the first embodiment, its explanation is omitted here.

The configuration of the ink recorder 90 fitted to a head portion 14 is described below with reference to FIG. 8. The ink recorder 90 is an apparatus which is used to eject ink onto a work cloth 99. The ink recorder 90 has an opening in an upper part thereof, and is equipped with a cartridge holder 92 which contains a detachable ink cartridge 91 filled with ink. The cartridge holder 92 has at its bottom a rectangular-parallelepiped compartment 93 which is longer in the back and forth direction of the sewing machine 100. With this, at the upper part of the compartment 93 in the cartridge holder 92, an ink cartridge 91 is contained which is longer in the back and forth direction and roughly rectangular in shape.

Between the compartment 93 and the ink cartridge 91, there is disposed a cartridge-side conduit (not shown) which is comprised of a flexible tube. The cartridge-side conduit has one end thereof connected to the bottom of the ink cartridge 91 and the other end thereof connected to the upper part of the compartment 93. Along the cartridge-side conduit, a cartridge-side conduit open-and-close electromagnetic valve 97 (see FIG. 10) is fitted. The amount of ink supplied from the ink cartridge 91 to the compartment 93 is controlled by opening and closing of the cartridge-side conduit open-and-close electromagnetic valve 97.

Behind a presser bar 31, the ink ejection head 95 is held by an ejection head holder 96. The ink ejection head 95 is cylindrical in shape, has an opening at its lower end and ejects the ink charged in the compartment 93. The ejection head holder 96 is fixed to the presser bar 31. Between the ink ejection head 95 and the compartment 93, there is disposed a head-side conduit 94 which is comprised of a flexible tube. The head-side conduit 94 has one end thereof connected to the bottom of the compartment 93 and the other end thereof connected to the upper part of the ink ejection head 95. At the connection between the head-side conduit 94 and the bottom of the compartment 93, a head-side conduit open-and-close electromagnetic valve 98 (see FIG. 10) is fitted. The head-side conduit open-and-close electromagnetic valve 98 is used to control the amount of ink that is supplied to the ink ejection head 95. The ink recorder 90 may be equipped with a sensor that detects the remaining amount of ink in the ink cartridge 91 such that the sensor signals when the ink cartridge 91 needs to be replaced, such as when the remaining amount of ink drops below a predetermined level.

Next, the electrical configuration of the sewing machine 100 is described below with reference to FIG. 9. The sewing machine 100 has much the same electrical configuration as the sewing machine 1 in the first embodiment and only its components that are different from those of the sewing machine 1 in the first embodiment are described below.

In the sewing machine 100 of the second embodiment, the above-described sewing start switch 21, sewing stop switch 22, needle up and down switch 23, presser foot elevation switch 24, reverse stitch switch 25, touch panel 26, potentiometer 52, and speed control lever 70, as well as a cartridge-side conduit open-and-close electromagnetic valve 97 and the head-side conduit open-and-close electromagnetic valve 98 are connected to an input interface 65. The cartridge-side conduit open-and-close electromagnetic valve 97 may control the amount of ink which is supplied from the ink cartridge 91 to the compartment 93. The head-side conduit open-and-close electromagnetic valve 98 may control the amount of ink which is supplied from the compartment 93 to the ink ejection head 95.

Next, the operations of the sewing machine 100 in the second embodiment are described below with reference to the flowcharts of FIGS. 4, 5, and 10. In the sewing machine 100 in the second embodiment, main processing and sewing processing which is performed in the main processing are the same as those by the sewing machine 1 of the first embodiment, and their explanation is omitted here. In the following, the practice sewing control processing that is different from that of the first embodiment is described.

This processing is performed if the sewing start switch 21 is operated in the "practice mode". As shown in FIG. 10, in step 41 (S41), during a predetermined period of time, the cartridge-side conduit open-and-close electromagnetic valve 97 and the head-side conduit open-and-close electromagnetic valve 98 of the ink recorder 90 are opened to eject ink. In step 42 (S42), a predetermined period of time, the wait processing is performed. The ink ejection lapse of time at S41 and the wait lapse of time at S42 are calculated on the basis of a lapse of time corresponding to a sewing speed that is set by a speed control lever 70. For example, if the sewing speed in actual sewing is set to 300 stitches per minute, it takes 0.2 seconds for each stitch of the sewing needle 29 (each vertical reciprocation of a needle bar) to be formed. For example, the ink ejection lapse of time may be 0.1 seconds and the wait lapse of time may be 0.1 seconds. However, the ratio between the lapses of time need not always be set to 1:1. The ink ejection lapse of time and the wait lapse of time may be set to 0.15 seconds and 0.5 seconds, respectively, to 0.08 seconds and 0.12 seconds, respectively. As the ink ejection lapse of time increases, an ink trajectory which is marked on the work cloth will be elongated and the inter-mark distance will be small.

In such a manner, in the sewing machine 100 in the second embodiment, when the sewing machine 100 is in the practice mode, the sewing needle 29 does not operate because the sewing needle 29 can be driven by the sewing machine motor independently. Additionally, instead of driving the sewing needle 29, the ink recorder 90 causes ink to be ejected to the same position on the work cloth as the position at which a needle drop hole is formed through which the sewing needle pierces the work cloth as the needle bar is driven in the up and down direction, thereby generating a predetermined mark on the work cloth. Therefore, the user can confirm a trajectory (marks) of the ink ejected to the work cloth in place of stitches which would be formed when the sewing needle 29 is actually driven in actual sewing. Also, the user can confirm the results of his/her practice. Further, since the sewing needle 29 is not driven, the work cloth 99 will not be damaged. Moreover, since a thread is not used in this case, the thread can be conserved. The user can practice repeatedly by employing ink that can be erased with water, heat, etc. The user can also practice changing the ink ejection lapse of time to change the shape of the mark, and practice changing the color of the ink. If the marked trajectory is preferable, actual sewing can be performed along that trajectory.

Figure 11:
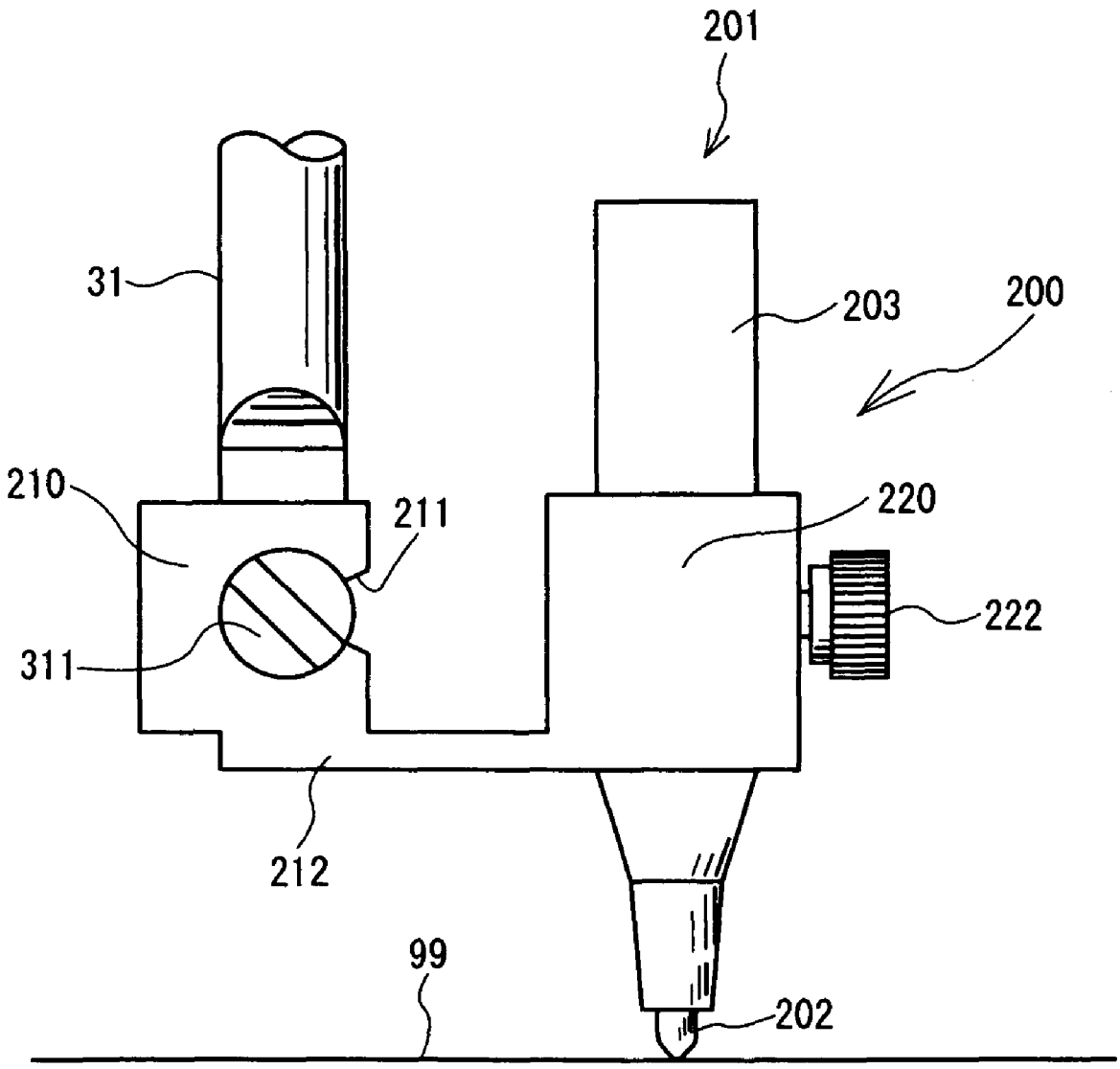
FIG. 11 is a side view of a marker recorder as viewed from the left side of the sewing machine in a condition where it is mounted to the sewing machine.
Figure 12:
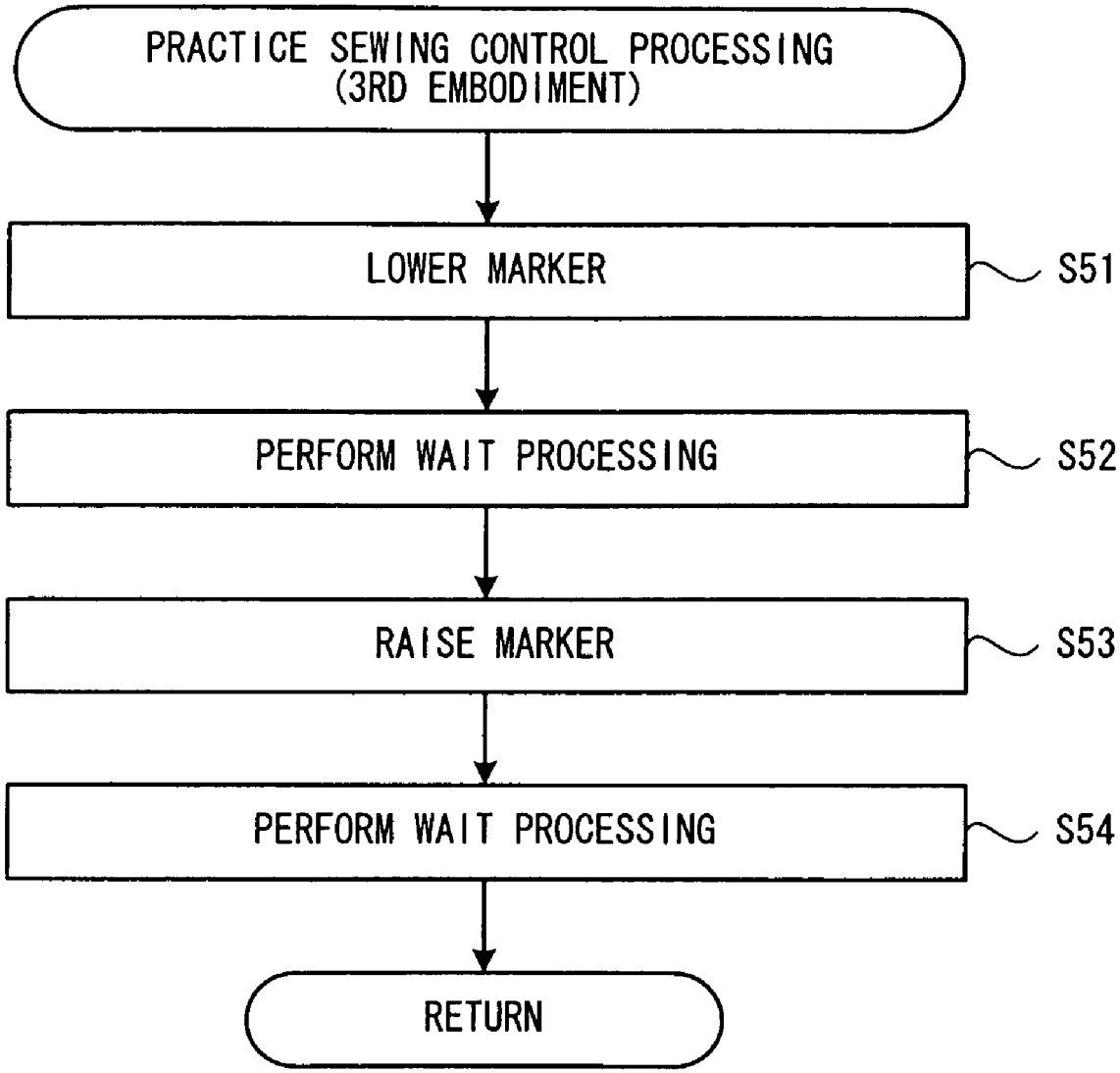
FIG. 12 is a flowchart of the practice sewing control processing in a third embodiment.

Next, a third embodiment is described below with reference to FIGS. 11 and 12. It is possible to mount a marker recorder 200 equipped with a marker 201 at a presser bar 31, instead of the presser foot 30. In a practice mode, the marker 201, rather than the presser foot 30, moves up and down. It is to be noted that because the third embodiment has the same physical configuration as that of the sewing machine 1, its explanation is omitted here.

First, the marker recorder 200 is described below. As shown in FIG. 11, the marker recorder 200 may be fitted with the presser bar 31. The marker recorder 200 may be comprised of an attachment member 210 which is fixed to the presser bar 31 and a marker retaining member 220 that holds the marker 201. The attachment member 210 is thin sheet shaped and has a notch 211 formed therein to which a screw member 311 mounted at the tip of the presser bar 31 is fitted. By fitting the screw member 311 to the notch 211 and tightening the screw member 311, the attachment member 210 is fixed to the presser bar 31. At the lower end of the attachment member 210, a thin sheet shaped coupling member 212 is provided in parallel with the horizontal direction of the sewing machine 1, while at the other end of the coupling member 212, the marker retaining member 220 is provided. The marker retaining member 220 is cylindrical in shape and can hold a body 203 of the marker 201 in its tube. The marker retaining member 220 has a screw 222 thereon that can fix the marker 201 in the tube of the marker retaining member 220. If the sewing machine 1 operates in the practice mode when the marker 201 is attached to the marker retaining member 220 after the vertical position of a pen point 202 of the marker 201 is adjusted so that it may come in contact with a work cloth 99 at a lowered position of the presser bar 31, the pen point 202 of the marker 201 contacts the work cloth 99 to draw a trajectory of the marker 201.

Next, the operations of the sewing machine 1 in the third embodiment are described below with reference to the flowcharts of FIGS. 4, 5, and 12. In the sewing machine 1 of the third embodiment, main processing and sewing processing which is performed in the main processing are the same as those by the sewing machine 1 in the first embodiment, and their explanations are omitted here. The practice sewing control processing that is different from that in the first embodiment is described.

This practice sewing control processing is performed if a sewing start switch 21 is operated in the "practice mode". As shown in FIG. 12, in step 51 (S51), the presser bar 31 fitted with the marker recorder 200 is lowered (S51). Subsequently, in step 52 (S52) the wait processing is performed during a predetermined period of time, then in step 53 (S53), the presser bar 31 having the marker recorder 200 is raised in step 54 (S54), the wait processing is performed for a predetermined period of time and then the present processing is ended to return to sewing processing. During this lapse of time, the sewing machine motor 79 is not driven to operate the sewing needle 29, so that no actual sewing is performed.

It is to be noted that, at S51, the marker recorder 200 is lowered by driving a presser foot elevation pulse motor 43 in such a manner that lowers a rack formation member 41 in an elevation mechanism 40, which raises and lowers the presser bar 31. At S53 the marker recorder 200 is raised by driving the presser foot elevation pulse motor 43 in such a manner that raises the rack formation member 41 in the elevation mechanism 40, which raises and lowers the presser bar 31. During a lapse of time when the marker recorder 200 is at a lowered position, the pen point 202 of the marker 201 stays in contact with the work cloth to perform recording.

Further, the wait lapses of time at S52 and S53 are determined so as to correspond to a sewing speed which is set with a speed control lever 70. For example, if the sewing speed in actual sewing is set to 300 stitches per minute, it takes 0.2 seconds for each stitch of the sewing needle 29 (each vertical reciprocation of a needle bar) to be formed. Further, if it takes, for example, 0.05 seconds each for the elevation mechanism 40 to raise and lower the presser foot 30, the wait lapse of time is 0.05 seconds (=0.1-0.05).

As can be seen, the sewing machine of the third embodiment is equipped with the marker recorder 200 instead of the presser foot 30. In the "practice mode", instead of the presser foot 30 the marker recorder 200 that is equipped with the marker 201 moves independently of the sewing machine up and down. In a condition where the marker recorder 200 is at a lower position, the marker 201 comes in contact with the work cloth 99, and the needle bar is driven in the up and down direction to give a predetermined mark to the same position on the work cloth as the position at which a needle drop hole would be formed through which the sewing needle would pierce the work cloth. It is thus possible to confirm a trajectory of ink, instead of stitches which are formed when the sewing needle 29 is driven during actual sewing. Additionally, the results of practice can be confirmed. Further, since the sewing needle 29 is not driven, the work cloth 99 will not be pierced or damaged. Moreover, because a thread is not used in this case, the thread can be conserved. The user can practice repeatedly by employing ink that can be erased with water, heat, etc. The user can also practice changing the ink ejection lapse of time to change the shape of the mark, and practice changing the color of the ink. If a marked trajectory is preferable, sewing can be performed actually along that trajectory.

It is to be noted that the sewing machine of the present disclosure is not limited to the above-described embodiments and, of course, can be modified variously without departing from the spirit of the present disclosure. The above embodiments have the sewing start switch 21 to initiate the start of sewing and the sewing stop switch 22 to stop sewing. The embodiments have the speed control lever 70 to adjust a sewing speed. However, the start/stop of sewing and the setting of a sewing speed may be controlled by using a known foot controller 85, such as shown in FIG. 13.

Figure 13:
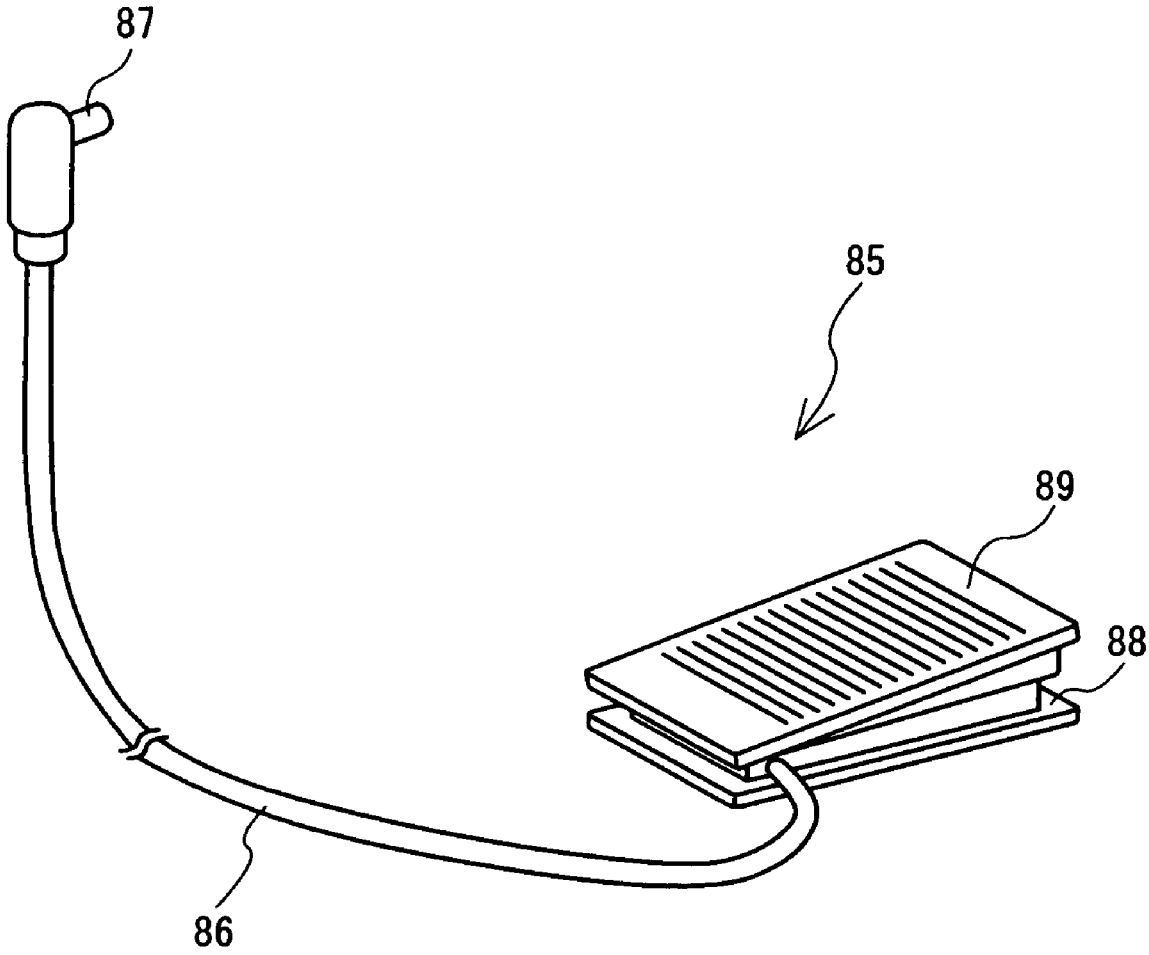
FIG. 13 is an illustration showing a foot controller.

As shown in FIG. 13, the foot controller 85 has a lower side case 88 and an upper side case 89 which is pivoted on the lower case 88 in such a manner that it can move up and down. A substrate (not shown) contained in the lower side case 88 includes a drive circuit, a speed control circuit (not shown), etc. The foot controller 85 has a cable 86 that has a connector 87 attached to an end thereof for connecting to the sewing machine 1, 100, or 300. On the other hand, a pillar 12 of the sewing machine 1, 100, or 300 has a jack (not shown) on its right side surface (see FIG. 1) for inserting the connector 87 to which the foot controller 85 is connected. A signal output from the substrate is input through the cable 86 into the sewing machine 1, 100, or 300. If the user steps on the upper side case 89 in operation, the sewing machine motor 79 starts to revolve, and thus starts sewing. If the user releases the upper case, the sewing machine motor 79 stops revolving, and thus sewing is stopped. Further, the user can instruct a sewing speed by adjusting the degree of stepping. The more the user steps on the foot controller 85, the higher the sewing speed will be.

In a case where the foot controller 85 is connected to the sewing machine 1, 100, or 300, at S4 in the main processing shown in FIG. 4, it is determined whether the foot controller 85 has been moved down (stepped on) instead of determining whether the sewing start switch 21 is being operated. If the first controller 85 has been stepped on, it is determined that the start of sewing has been initiated, and the process goes to S6. At S22 in the sewing processing shown in FIG. 5, it is also determined whether stepping on the foot controller 85 has ceased, instead of determining whether the sewing stop switch 22 is being operated. If the stepping on the foot controller 85 has ceased, it is determined that the sewing has ended and the process goes to S26. At S31 in the practice sewing control processing shown in FIG. 6, the processing that corresponds to a sewing speed is performed which is instructed in accordance with the degree of stepping on the foot controller 85. Therefore, the user can practice by using the foot controller 85 to stop sewing as well to adjust a sewing speed.

What is claimed is:

1. A sewing machine comprising:

a needle bar that is equipped with a sewing needle at a lower end of the needle bar;

a presser bar that is equipped with a presser foot at a lower end of the presser bar, which holds down a work cloth;

a sewing machine motor which is a driving source that drives the needle bar in an up and down direction;

a switching device that switches between a normal mode in which the needle bar is driven in the up and down direction to form stitches, and a practice mode in which the sewing machine is operated in a condition where at least the needle bar is not driven;

a presser member drive mechanism that drives at least one of the presser foot and the presser bar in the up and down direction; and a presser member drive control device that controls the presser member drive mechanism, wherein if the sewing machine is in the practice mode, the presser member drive control device controls the presser member drive mechanism independently of the sewing machine motor.

2. The sewing machine according to claim 1, wherein the presser member drive control device is equipped with a speed control device that controls an up and down directional driving speed of the presser foot.

3. A sewing machine comprising:

a needle bar that is equipped with a sewing needle at a lower end of the needle bar a presser bar that is equipped with a presser foot at a lower end of the presser bar, which holds down a work cloth;

a sewing machine motor which is a driving source that drives the needle bar in an up and down direction;

a switching device that switches between a normal mode in which the needle bar is driven in the up and down direction to form stitches, and a practice mode in which the sewing machine is operated in a condition where at least the needle bar is not driven; and a marking device that generates a predetermined mark to a same position that is the same as a position at which a needle drop hole is formed as a result of the sewing needle piercing the work cloth when the needle bar is driven in the up and down direction, wherein if the sewing machine is in the practice mode, the predetermined mark is given to the work cloth by the marking device independently of the sewing machine motor.

4. The sewing machine according to claim 3, wherein the marking device is equipped with an ink ejector that generates the predetermined mark to the work cloth by ejecting ink to the work cloth.

5. The sewing machine according to claim 3, wherein the marking device is equipped with a marker that gives the predetermined mark to the work cloth by butting against the work cloth.

6. A non-transitory computer-readable recording medium storing a sewing machine control program, the control program comprising:

switching instructions for switching between a normal mode in which a needle bar having a sewing needle attached to a lower end of the needle bar is driven in an up and down direction to form stitches; and a practice mode in which a sewing machine is operated in a condition where at least the needle bar is not driven; and presser member drive control instructions for driving in an up and down direction at least one of a presser foot that presses a work cloth and a presser bar having the presser foot at a lower end of the presser bar, independently of a sewing machine motor which is a driving source that drives the needle bar in the up and down direction, when the sewing machine is in the practice mode.

7. The recording medium according to claim 6, wherein the presser member drive control instructions include speed control instructions for controlling an up and down directional driving speed of the presser foot.

8. The recording medium according to claim 6, further comprising marking instructions for generating a predetermined mark to a same position that is the same as a position at which a needle drop hole is formed as a result of the sewing needle piercing the work cloth when the needle bar is driven in the up and down direction, wherein if the sewing machine is in the practice mode, the predetermined mark is given to the work cloth by the marking instruction independently of the sewing machine motor.

9. The recording medium according to claim 8, wherein the marking instructions include ejection time control instructions for controlling an ejection time when ink is ejected from an ink injector to the work cloth.

* * * * *